US007270639B2

(12) United States Patent
Jensen et al.

(10) Patent No.: US 7,270,639 B2
(45) Date of Patent: Sep. 18, 2007

(54) TEMPERATURE REGULATION SYSTEM FOR AUTOMATIC CHEST COMPRESSION HOUSING

(75) Inventors: James O. Jensen, Sunnyvale, CA (US); Vladimir Rappoport, Sunnyvale, CA (US); Robert Mastromattei, Sunnyvale, CA (US)

(73) Assignee: Zoll Circulation, Inc., Sunnyvale, CA (US)

( * ) Notice: Subject to any disclaimer, the term of this patent is extended or adjusted under 35 U.S.C. 154(b) by 552 days.

(21) Appl. No.: 10/686,188

(22) Filed: Oct. 14, 2003

(65) Prior Publication Data

US 2005/0080363 A1 Apr. 14, 2005

(51) Int. Cl.
*A61H 31/00* (2006.01)

(52) U.S. Cl. ..... 601/41; 601/DIG. 6

(58) Field of Classification Search ..... 601/41–44
See application file for complete search history.

(56) References Cited

U.S. PATENT DOCUMENTS

| | | | | |
|---|---|---|---|---|
| 4,291,686 | A * | 9/1981 | Miyashiro | 601/101 |
| 5,014,141 | A * | 5/1991 | Gervais et al. | 242/352.1 |
| 5,287,846 | A * | 2/1994 | Capjon et al. | 601/44 |
| 6,066,106 | A * | 5/2000 | Sherman et al. | 601/41 |
| 2002/0088893 | A1 * | 7/2002 | Nichols | 242/546 |

* cited by examiner

*Primary Examiner*—Danton DeMille
(74) *Attorney, Agent, or Firm*—K. David Crockett, Esq.; Paul J. Backofen, Esq.; Crockett & Crockett

(57) ABSTRACT

Devices and methods for cooling an electro-mechanical chest compression device. A blower or fan forces air through the device and a metal foil distributes heat. The temperature of the device and the patient is measured and the processor controls the operation of the device based on the measured temperature.

5 Claims, 5 Drawing Sheets

TEMPERATURE REGULATION SYSTEM FOR AUTOMATIC CHEST COMPRESSION HOUSING

FIELD OF THE INVENTIONS

The inventions described below relate the field of cardiopulmonary resuscitation and in particular to automatic chest compression devices.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., *Decay In Quality Of Chest Compressions Over Time,* 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45 to 90 minutes) have been reported, with the victims eventually being saved by coronary bypass surgery. See Tovar, et al., *Successful Myocardial Revascularization and Neurologic Recovery,* 22 Texas Heart J. 271 (1995).

In efforts to provide better blood flow and increase the effectiveness of bystander resuscitation efforts, various mechanical devices have been proposed for performing CPR. In one variation of such devices, a belt is placed around the patient's chest and an automatic chest compression device tightens the belt to effect chest compressions. Our own patents, Mollenauer et al., Resuscitation device having a motor driven belt to constrict/compress the chest, U.S. Pat. No. 6,142,962 (Nov. 7, 2000); Bystrom et al., Resuscitation and alert system, U.S. Pat. No. 6,090,056 (Jul. 18, 2000); Sherman et al., Modular CPR assist device, U.S. Pat. No. 6,066,106 (May 23, 2000); and Sherman et al., Modular CPR assist device, U.S. Pat. No. 6,398,745 (Jun. 4, 2002); and our application Ser. No. 09/866,377 filed on May 25, 2001, and our application Ser. No. 10/192,771, filed Jul. 10, 2002 show chest compression devices that compress a patient's chest with a belt. Each of these patents or applications is hereby incorporated by reference in their entireties.

Since seconds count during an emergency, any CPR device should be easy to use and facilitate rapid deployment of the device on the patient. Our own devices are easy to deploy quickly and may significantly increase the patient's chances of survival. Nevertheless, a novel chest compression device has been designed to further increase ease of use, further facilitate rapid deployment and further increase the durability and convenience of the device.

A problem encountered when building a lightweight, compact electro-mechanical chest compression device was that the device could overheat. (The motor, brake and electrical systems all produce heat.) Overheating can damage the device and may injure the patient.

SUMMARY

The devices and methods described below provide for an electro-mechanical chest compression device having a cooling system that reduces overheating of the device and of the patient, the rescuers and other persons contacting the device. Vents are provided in the device housing, allowing air to circulate inside the housing. A blower is provided to improve air circulation. A metal sheet is provided on the inside surface of the anterior cover plate to distribute heat generated by the motor, brake and electronics.

DETAILED DESCRIPTION OF THE INVENTIONS

Figure 1:
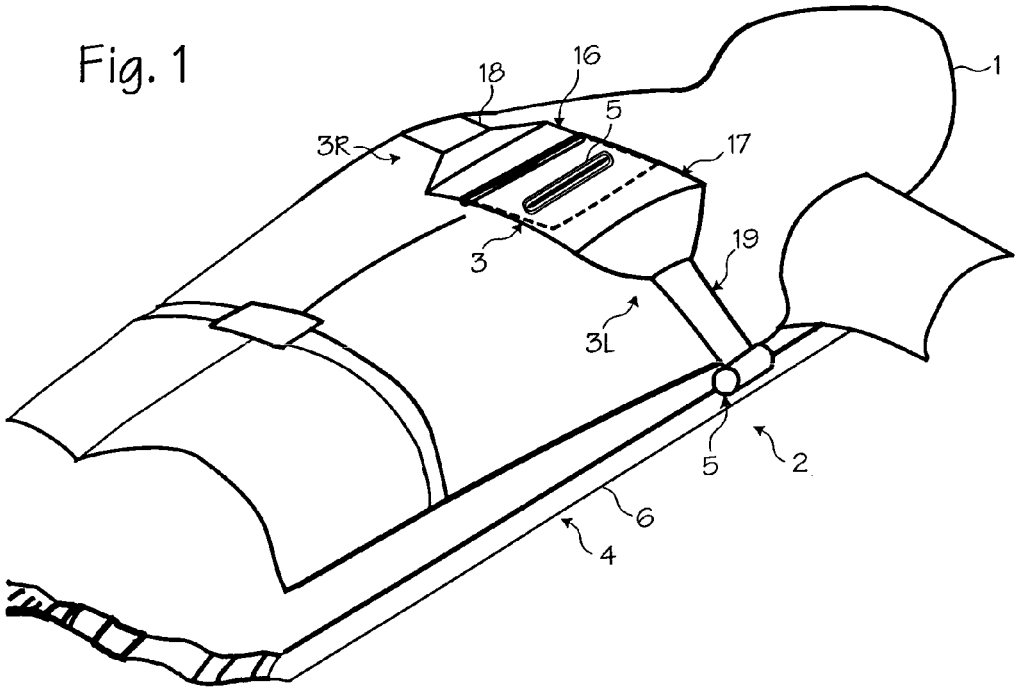
FIG. 1 illustrates a method of performing chest compressions on a patient by using an automatic chest compression device.

FIG. 1 shows the chest compression belt fitted on a patient 1. A chest compression device 2 applies compressions with the belt 3, which has a right belt portion 3R and a left belt portion 3L. The chest compression device 2 includes a belt drive platform 4 and a compression belt cartridge 5 (which includes the belt). The belt drive platform includes a housing 6 upon which the patient rests, a means for tightening the belt, a processor and a user interface disposed on the housing. The belt includes pull straps 18 and 19 and wide load distribution sections 16 and 17 at the ends of the belt. The means for tightening the belt includes a motor attached to a drive spool, around which the belt spools and tightens during use. The design of the chest compression device, as shown herein, allows for a lightweight electro-mechanical chest compression device. The fully assembled chest compression device weighs only 29 pounds, and is thus hand-portable over long distances. (The device itself weighs about 22.0 to 23.0 pounds, the battery weighs about 5.0 pounds, the belt cartridge weighs about 0.8 pounds and the straps to secure the patient weigh about 1.6 pounds.) To date, the chest compression device described below is the only self-contained electro-mechanical or belt-based automatic chest compression device known to the inventors that weighs less than 30 pounds.

Figure 2:
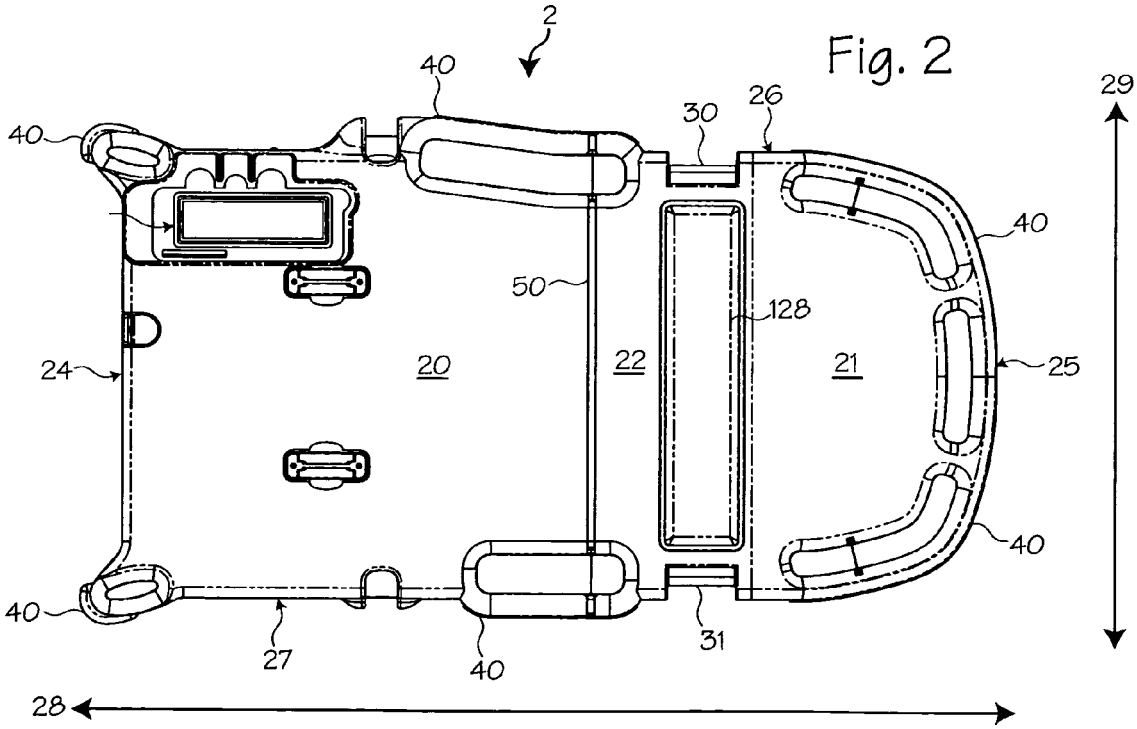
FIG. 2 shows the anterior side of an electro-mechanical chest compression device.

FIG. 2 shows the anterior side of an electro-mechanical chest compression device 2. The chest compression device includes the belt drive platform 4 and the belt cartridge 5. The belt drive platform includes a headboard 20, upon which the patient's head rests, and a backboard 21, upon which the patient's back rests. Preferably, the headboard and backboard are part of one, integral plate of material. The chest compression device 2 is described in relation to the patient when the patient's back is on the backboard and the patient's head is on the headboard. Thus, in normal use, the top of the device is the anterior side 22 (the side upon which the patient rests during use), the bottom of the device is the posterior side 23 (the side facing the ground during use, shown in FIGS. 3 and 4), the front of the device is the superior side 24 and the back of the device is the inferior side 25. The left side 26 and right side 27 of the device are to the left and right of the patient, respectively, when the device is in use.

The device is lightweight and compact. The superior-inferior height of the device (along arrow 28) is about 32 inches and the lateral width of the device (along arrow 29) is about 19 inches. The anterior-posterior thickness of the device is about 3 inches. The distance between a left belt spindle 30 and a right belt spindle 31 is in the range of about 12 inches to about 22 inches. Preferably, the distance between the spindles is about 15 inches so that the device will accommodate the vast majority of patients. Specifically, the distance is measured from the lateral, outer edge of one spindle to the lateral, outer edge of the other spindle. (The device may be made larger to accommodate very large patients.)

Figure 3:
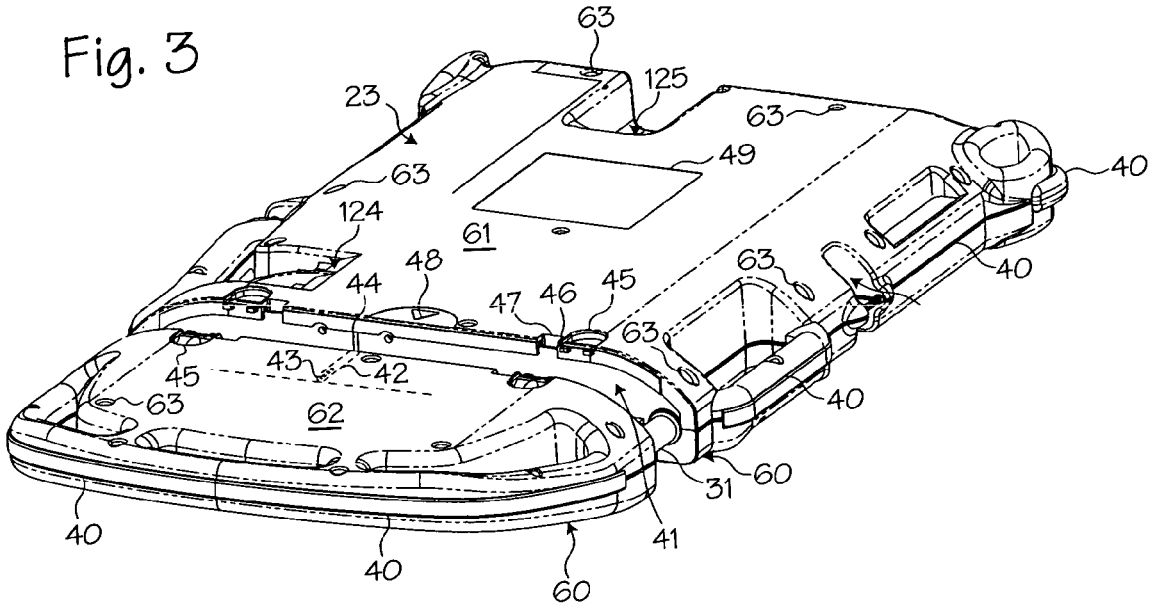
FIG. 3 shows the inferior and posterior sides of the automatic chest compression device.
Figure 4:
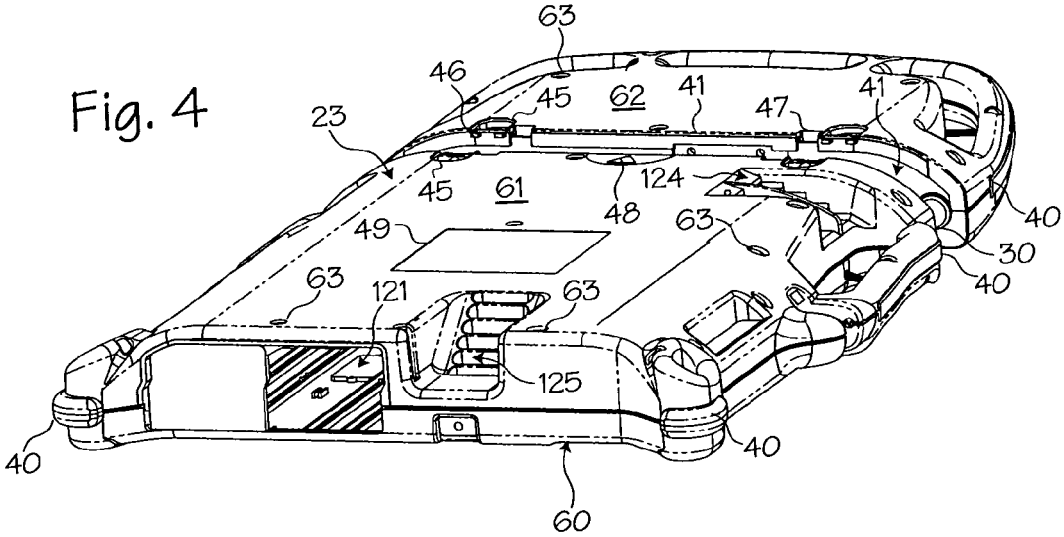
FIG. 4 shows the superior and posterior sides of the automatic chest compression device.
Figure 5:
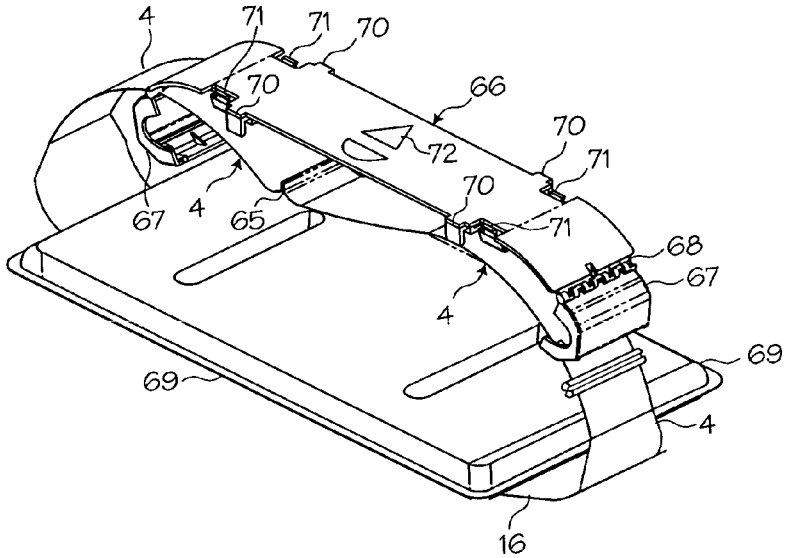
FIG. 5 shows a compression belt cartridge for use with the chest compression device.

In use, a belt cartridge is provided and is secured to the posterior side of the chest compression device, as described in reference to FIGS. 3 through 5. The patient is then placed on the device. The belt extends over and around the left spindle and the right spindle, under the patient's axilla (armpits) and around the patient's chest. The load distribution sections are then secured over the patient's chest. The chest compression device then tightens the belt repetitively to perform chest compressions.

FIGS. 3 and 4 show the posterior side 23 of the chest compression device as seen from the inferior and superior directions, respectively. (In the perspective of FIGS. 3 and 4, the average sized patient's buttocks and the back of the patient's legs would extend past the inferior bumper 40.) The device is built around a sturdy channel beam 41 that is laterally oriented with respect to the housing. The channel beam supports the device against the forces created during compressions. The channel beam also serves as the structure to which the belt cartridge is attached. The channel beam 41 is formed from a single piece of cast aluminum alloy that forms two walls perpendicular to a flat bottom portion. (The channel beam may be formed from separate components and of other suitably strong and stiff materials, such as steel, magnesium, or reinforced polymer composites.) To accommodate the belt, the channel beam is about 2.5 inches high (along the superior-inferior direction), about 12 inches to about 16 inches long (along the left-right direction) and about 2 inches deep (from the bottom portion to the top of a wall portion).

The channel beam 41 forms a channel extending across the lateral width of the device. During compressions, the belt is disposed in and travels along the channel. The belt is attached to a drive spool 42 that spans the channel. The drive spool serves as a means for operably connecting the compression belt to the motor. (The drive spool is shown in phantom in FIG. 3 to indicate its position near the bottom surface of the channel beam.) The drive spool is less than 3 inches long and less than 1 inch in diameter. The drive spool may be located anywhere within the channel beam. Preferably, the drive spool extends across the channel beam at a location slightly offset from the vertical centerline of the device.

For example, the drive spool may have a conical shape for use with a cable attached to the pull straps (or when the belt is replaced with a cable). During initial spooling, the cable wraps around the base of the cone, thereby creating a large mechanical advantage when starting a compression. The cable then spools around the length of the cone, proceeding towards the peak of the cone. The drive spool applies more torque to the cable as the cable spools around the smaller diameter portions of the cone, thereby applying a greater force to the patient towards the end of a compression when the chest's resistance to the compression is highest. (The shape of the drive spool is the spooling profile of the device. The spooling profile may be customized to take advantage of the speed versus torque trade-off from the drive train or from the viscoelastic effects of the patient's chest).

The drive spool is provided with a slot 43 disposed along the length of the spool shaft. A spline attached to the belt is keyed to the shape of the drive spool slot. Thus, when the spline is inserted into the drive spool slot, the belt is securely fastened to the drive spool. A groove 44 in the channel beam walls assists in aligning and securing the spline to the drive spool slot. Similarly, one or more discs or guide plates mounted on one or both walls of the channel beam also assist in aligning and securing the spline to the drive spool slot. (The guide plate may also be operably attached to the drive spool or both the drive spool and the channel beam.) The guide plate is attached to a spring that allows the guide plate to move in and out of the channel, thereby allowing easy removal of the spline. When the guide plate springs back after insertion of the clip, the guide plate helps secure the spline in place. The guide plate may be provided with a slot sized and dimensioned to receive the spline, thereby further securing the spline within the drive spool slot.

The left spindle 30 and right 31 spindle are disposed on either end of the channel beam 41 and are mounted to the channel beam walls via sealed bearings. The spindles are hollow aluminum cylinders, having a length of about 2.5 inches and a diameter of about 0.75 inches, to minimize weight and to minimize their moments of inertia. The left and right spindles allow the compression belt to easily travel around the left and right sides of the device with a minimum of friction, thus conserving energy. The left and right spindles are disposed along the superior-inferior direction of the device such that the belt will easily wrap around the patient's chest when the patient is placed on the device. The spindles are inset into the sides of the housing in order to protect the patient, rescuer and device components. Belt guards disposed on the belt cartridge, shown in FIG. 5, also cover the spindles. The belt guards further protect the patient, rescuer and device components.

Also disposed on or near the channel beam are means for securing the compression belt cartridge to the channel beam. For example, a number of blind holes or slots 45 are disposed in the housing and along the edge of the channel beam. Corresponding alignment tabs disposed on the compression belt cartridge fit within the slots. The slots also have bosses or detents 46 that extend outwardly and into the channel a short distance. Snap latches disposed on the compression belt cartridge fit securely, though removably, within the bosses or detents. Similarly, a number of apertures 47 are disposed in the housing and along the edges of the channel beam 41. The compression belt cartridge is provided with tabs or hooks that fit into the apertures, thus further securing the cartridge to the channel beam. The slots and apertures are symmetrically located about the medial axis of the device. However, placing the slots and apertures asymmetrically about the medial axis of the device can ensure that the cartridge is attached to the channel beam in only one orientation.

In addition, the housing is provided with labeling, such as triangle 48, to assist a user with correctly attaching the compression belt cartridge. Labeling on the housing aligns with corresponding labeling disposed on the compression belt cartridge when the cartridge is correctly aligned with the device. Contrasting colors are used in the region of the triangle to further assist the user to align the cartridge. Additional labeling 49 may be added to the device to aid in aligning the patient with the device, or to provide warnings, operation instructions or advertising information. For example, recess 50 (shown in FIG. 2) disposed across the width of the device provides a visual alignment marker. The recess 50 also helps fluids to flow away from the surface of the device.

Although the channel beam 41 forms the backbone of the device, additional reinforcement for the device is provided by the device housing. Referring again to FIGS. 3 and 4, the shell housing comprises an anterior cover plate 60 attached to two posterior cover plates, a superior cover plate 61 and an inferior cover plate 62. The anterior cover plate is attached to the superior cover plate and the inferior cover plate via a plurality of threaded fasteners disposed in holes 63 or by interlocking features that snap together.

The superior cover plate 61 is disposed superiorly to the channel beam 41 and the inferior cover plate 62 is disposed inferiorly to the channel beam. (The housing may be formed from more or fewer cover plates, although using three cover plates is a preferred design with the devices shown in the FIGS. 2 through 7.) The three-piece shell design minimizes shear forces applied to the fasteners connecting the cover plates, thereby increasing the durability of the device. (The channel beam absorbs most shear forces.) In addition, the posterior edges of the channel interlock with ridges in the superior and inferior cover plates to protect the fasteners connecting the cover plates to the channel. Alignment pins and bumpers interdigitate with the overlapping cover plates, thereby providing further protection from shear forces.

The housing is constructed with rounded edges to minimize impact damage to people or to the device. The housing is formed from a hard, liquid-proof material that is easy to clean, has low thermal conductivity and is resistant to fire, electricity, chemicals, sun exposure and extreme weather conditions. (Such materials include acrylonitrile butadiene styrene, high molecular weight polyethylene, other polymer plastics and lightweight metals such as aluminum and titanium; however, metals should be provided with a coating or other feature to make the housing non-conducting.)

FIG. 5 shows a compression belt cartridge for use with the chest compression device. The cartridge has a belt 3, a spline 65 for attaching the belt to the chest compression device, a belt cover plate 66 for protecting the belt, and belt guards 67 rotatably attached to the belt cover plate via hinges 68. (The belt guards are disposed around the spindles during use.) The belt cartridge may also be provided with a compression bladder 69, which is placed between the belt and the patient's sternum during compressions. An example of a compression bladder is shown in our application Ser. No. 10/192,771, filed Jul. 10, 2002.

To attach the belt cartridge to the chest compression device, the belt spline 65 is inserted into the drive spool slot 43. The belt cover plate 66 is then secured to the channel beam 41 and housing 6 by inserting hooks 70 on the belt cover plate into the corresponding apertures 47 in the device and by inserting tabs and snap latches 71 within the slots 45 and bosses on the device. (The slots, apertures, tabs and hooks are aligned and begin sliding together prior to engagement of the snap latches within the bosses.) Labeling 72 disposed on the belt cover plate further assists the user to align the belt cover plate with the channel beam.

Figure 6:
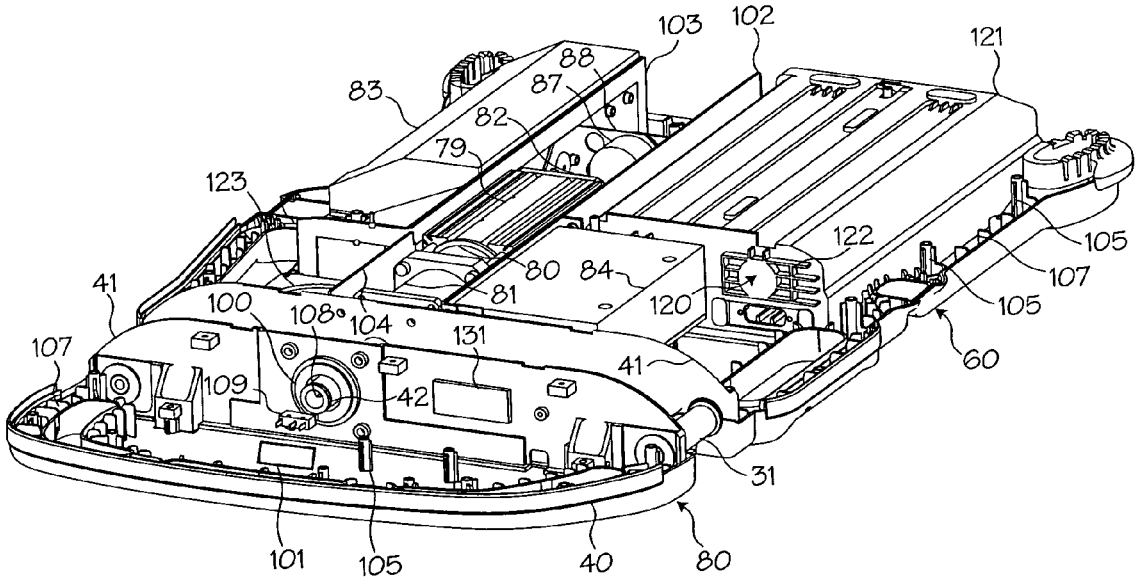
FIG. 6 shows the inferior and posterior sides of the automatic chest compression device with the superior and inferior cover plates removed.
Figure 7:
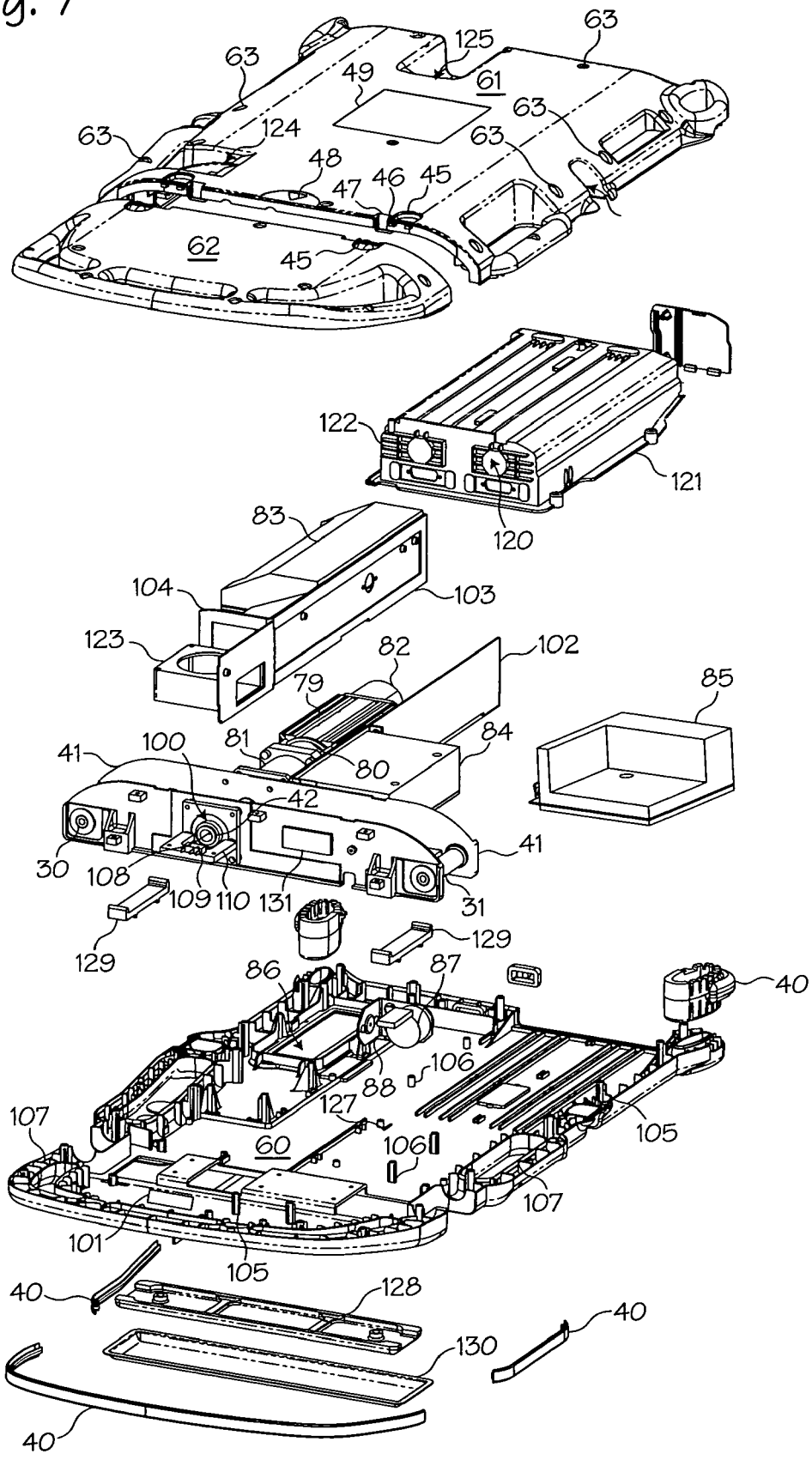
FIG. 7 shows an exploded view of the automatic chest compression device as seen from the posterior side of the device.

FIGS. 6 and 7 show the internal components of the chest compression device 2. A motor 79 is operable to provide torque to the drive spool 42 through a clutch 80 and a gearbox 81. A brake 82, attached to the superior side of the motor, is operable to brake the motion of the drive spool. The brake hub connects directly to the rotor shaft of the motor.

The drive spool extends across the channel is rotatably attached to the walls of the channel beam via bearings. Together, the drive spool, clutch, gearbox and brake compose the drive train of the device. Preferably, the drive train is not attached to any other component of the device or to the device housing, except via attachment of the drive spool to the channel beam. Thus, the drive train is cantilevered from the channel beam. When cantilevered from the channel beam, the drive train minimizes rotational resistance and rotational inertia, reduces undesirable bending or shearing forces on the components of the drive train, reduces the weight of the overall device and improves air flow around the components of the drive train (thereby improving cooling of those components).

The gearbox contains a gear system having a gear ratio that decreases the speed of the drive spool relative to the clutch or motor drive shaft. The gear ratio preferably about 10:1. Useable gear systems include planetary gear systems that operate in a straight line from the motor shaft to the output shaft (which is the drive spool shaft). Still other gear systems do not operate in a straight line, so that the motor and output shafts need not be along the same line. In the device shown in FIGS. 6 and 7, the drive spool is the output shaft of the gearbox.

The clutch disengages the motor from the gearbox if too much torque is applied to the drive spool. The control system can also disengage the clutch based on other sensed parameters; for example, the controller can control the clutch to disengage when too much load, as pre-determined by the manufacturer, is sensed at the load plate, when there is a software error or upon other conditions. Thus, the clutch serves as a safety mechanism for the chest compression device. Optionally, the clutch can be used actively during compressions to aid in timing compressions and conserving energy. An example of this use for a clutch is found in our U.S. Pat. No. 6,142,962. Preferably, the brake, motor, gearbox, clutch and drive spool are aligned in a straight line, perpendicular to the channel beam 41.

The motor 79 and brake 82 are controlled by a processor unit 83, motor controller 84 and power distribution controller 85, all of which are mounted to the inside of the anterior cover plate 60. (The power distribution controller is not shown in FIG. 6 in order to clearly show the end of the battery compartment.) The processor unit includes a computer processor, a non-volatile memory device and a display. A user may access the display through opening 86 in the housing. Additional feedback is given to the user though speaker 87 mounted on bracket 88.

The processor unit is provided with software used to control the power controller and the motor controller. Together, the processor unit, power controller and motor controller make up a control system capable of precisely controlling the operation of the motor. Thus, the timing and force of compressions are automatically and precisely controlled for patients of varying sizes. Examples of compression belt timing methods may be found in our U.S. Pat. No. 6,066,106 and in our application Ser. No. 09/866,377.

The motor controller may also be operably connected to a torque sensor that senses the torque applied by the motor to the drive spool. In this case, the motor controller is capable of automatically stopping the device if the torque exceeds a pre-set threshold. The motor controller or processor may also be attached to a biological sensor that senses a biological parameter, such as end-tidal carbon dioxide, pulse or blood pressure. The processor and motor controller are then operable to control the operation of the device based on the sensed biological parameter. Examples of motor control and biological feedback control are found in our patent, Mollenauer et al., Resuscitation Device Having a Motor Driven Belt to Constrict/Compress the chest, U.S. Pat. No. 6,142,962 (Nov. 7, 2000). The motor controller or processor may also be attached to a current sensor operable to sense the current in the motor. A sudden spike in the motor current indicates a sudden load on the motor, and is thus an indication of how much torque is being applied to the patient. Accordingly, control system may control the operation of the device based on the measured current in the motor.

The processor unit is also attached to a rotary encoder 100 disposed in the inferior portion of the housing and mounted on the channel beam 41. (The rotary encoder may be replaced with a linear encoder operably disposed with respect to the belt.) The rotary encoder measures the rotation of the drive spool 42 and produces spool data corresponding to drive spool rotation. The processor, together with an encoder controller 101 mounted in the inferior portion of the housing, translates the spool data into the total amount of belt take-up and into the total depth of compression accomplished by the system. The encoder controller converts pulses from the encoder into a count and direction signal, and the processor uses that signal to control the device. (The encoder controller and the encoder may be located elsewhere in the device; for example, the encoder may be located in the gearbox and operably connected to one of the gear shafts.) Examples of encoders as used with chest compression devices are found in our patent, Sherman et al., Modular CPR assist device, U.S. Pat. No. 6,066,106 (May 23, 2000) and in our application Ser. No. 09/866,377 filed on May 25, 2001.

Referring again to FIGS. 6 and 7, a number of additional features are provided to the device to increase its utility and safety. Additional reinforcement for the device is provided by ribs 102, 103 and 104. The ribs are metal plates that support the housing during use, thereby protecting the device and device components. All ribs are disposed in the same plane as the motor to conserve space. More ribs may be added to provide further reinforcement to the device. The edges of the ribs are sealed with foam so that any liquid that does enter the device will not contact the controller board, power distribution board, motor controller, other electronics and associated cables.

Further reinforcement is provided by hollow posts 105 integrally formed with the housing cover plates. The hollow posts are open at one end where the threaded fasteners are inserted to connect the cover plates to each other. (The openings in the posts correspond to the holes 63 in FIGS. 3 and 4) Additional, internal mounting posts 106 are provided to mount electronic systems and suspend them off the floor of the device. Thus, the internal mounting posts help prevent any liquids that enter the device from pooling on the electronics. Still further reinforcement is provided by gussets 107 mounted throughout the device housing. The multiply redundant reinforcements and the tight-fitting compartmentalized design of the device provide very high protection against force, shock and vibration. The device shown in FIGS. 2 through 7 can resist more than 1,200 pounds of distributed force.

To protect the patient and users from accidental activation, or activation when a belt is not secured to the device, a means for sensing the presence of the belt is provided. The drive spool slot 43 is provided with a pin 108 that is longitudinally translatable through the drive spool and the rotary encoder. The pin is attached to a spring that urges the pin into the drive spool slot. When a belt spline is inserted into the drive spool slot, the pin is pushed through the drive spool and rotary encoder and towards a contact switch 109. The contact switch is mounted on brace 110 that is itself mounted to the channel beam 41. The contact switch is operably connected to the encoder controller (and thereby to the processor). When the belt is inserted, the pin is pushed against the contact switch and the device thereby registers the presence and proper insertion of the belt spline. To provide additional safety, the spline is keyed to the drive spool slot so that movement of the pin towards the contact switch is difficult unless the spline is inserted into the slot. Other means for sensing the presence of the belt may be used; for example, the drive spool slot may be provided with an electrical contact that senses the presence of the belt.

In addition, the spool shaft is provided with a detent that locks the shaft in place when the spline is removed. The detent holds the spool shaft at a particular position to aid in insertion of the spline. Holding the spool shaft at a particular position also maintains the relationship between the actual physical position of the spool and the position of the spool as measured by the control system. Thus, the starting position of the spool shaft does not change while the device is turned off. This, in turn, helps to maintain the accuracy of measuring the actual amount of belt travel during compressions.

The chest compression device is provided with a control system that controls how the belt is wrapped around the drive spool. For example, the drive spool is controlled so that some of the belt is left wrapped around the drive spool between compressions (that is, when the device has loosened the belt around the patient, just before beginning the next compression). Preferably, a length of the belt corresponding to one revolution of the drive spool is left wrapped around the drive spool at all times during compressions. Thus, the belt will maintain its curled shape, reduce the chance of causing folds in the belt during compressions and increase the efficiency of spooling the belt around the drive spool.

FIGS. 6 and 7 also show the location of the battery compartment near the head of the patient. The location and design of the battery pack and battery compartment allow for rapid exchange of batteries. A spring in the back of the compartment forces the battery pack out unless the battery pack is fully and correctly inserted in the compartment. Recesses 120 indicate the location of the springs inside the battery compartment 121. Plastic grills 122 at the end of the battery compartment reinforce the recesses.

To cool the device and the device electronics, a blower 123 is provided to circulate air inside the device. Outside air is drawn in from either the left louvered vent 124 or the superior louvered vent 125 and is expelled from the other vent, thereby assisting in cooling the device components. (In the devices shown in FIGS. 2 through 7, air is drawn in the left vent and is blown out the superior vent.) The vents are disposed in inwardly sloping recesses that are disposed in the housing. The recesses help prevent liquids from entering the vents.

Temperature inside the housing is measured with a temperature sensor 127, such as a thermometer or thermistor, mounted on the inside of the anterior cover plate. If the temperature exceeds a pre-set temperature, then the processor is programmed to control the systems of the device to cool the device. For example, the processor may increase the speed of the blower, reduce motor speed or prompt the user to clear blocked vents or move the patient and device to a cooler location.

A means for measuring force is operably attached to the device. The means for measuring force is operable to measure the force the patient applies to the device and the force of compressions. The means for measuring force is a load plate 128 attached to two load cells 129. Other means for sensing force or weight may be used, such as one or more strain gauges or springs operably attached to the channel beam. A load plate cover 130, made from a high-density polyethylene polymer, Santoprene rubber or similar materials, is also provided to seal the inside of the device from liquids and other contaminants.

A back-up battery may also be provided with the system to provide power when the main batteries are not attached. The back-up battery is mounted to a mounting plate 131 on the channel beam 41. The mounting plate is a thickened region of the channel beam itself, though the mounting plate may be a separate component mounted to the channel beam.

Figure 8:
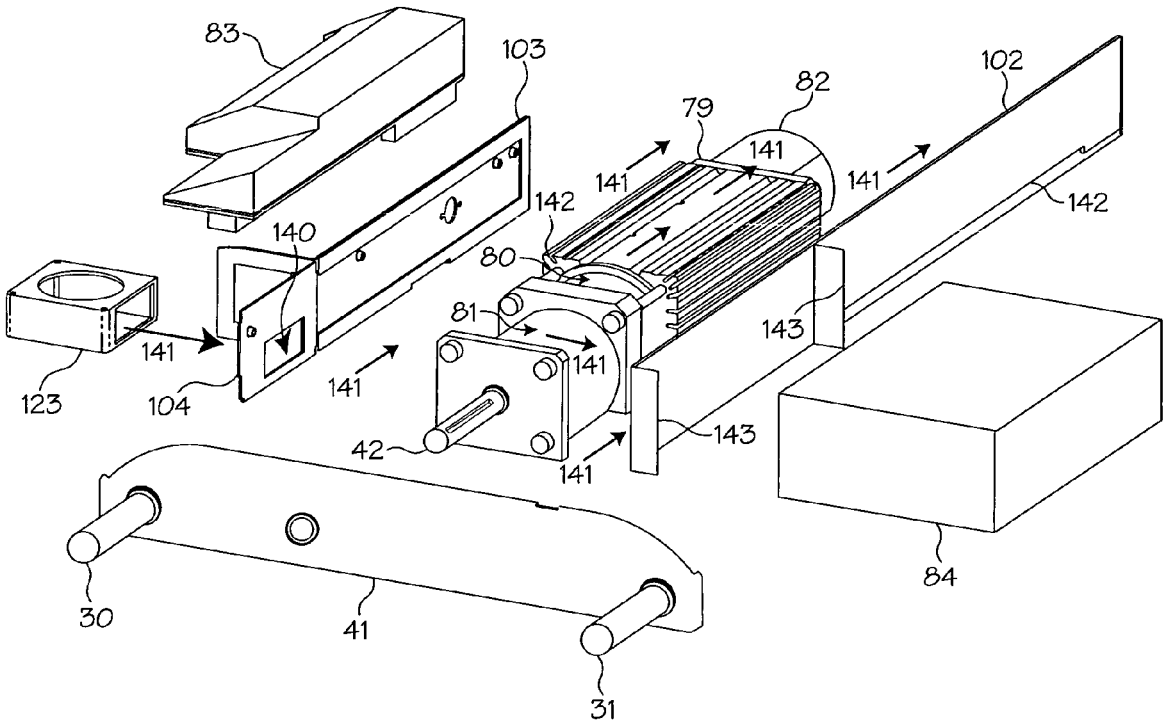
FIG. 8 shows an exploded view of some of the internal components of the device.

FIG. 8 shows an exploded view of some of the internal components of the device (also shown in FIG. 7). The display and processor unit 83; ribs 102, 103, and 104; blower 123; drive spool 42, motor 79, clutch 80, gearbox 81 and brake 82; part of the channel beam 41, the left spindle 30 and the right spindle 31; and the central rib 102 and motor controller 84 are separated to show the air path around the drive train. The motor, brake and electronics all produce excess heat that can cause the device to malfunction or be permanently damaged. Excess heat may also harm the patient or rescuers if the device overheats. Thus, cooling mechanisms are needed to provide a means for removing heat from the device.

One means for removing heat is to circulate outside air throughout the device and to force heated air out of the device. As described in reference to FIGS. 6 and 7, the blower draws outside air from one vent and through the top of the blower. The blower then expels air through opening 140 in rib 104 and into the device. Air circulates in the device and is ultimately expelled from the other vent. (Airflow may be reversed, so that the blower blows air from inside the device to outside the device). The blower itself is a ComAir/Rotron Model WT12B3-E2, 12-volt blower. Although any suitable blower, fan or other cooling device of similar capacity may be used, a blower is preferable since it is more compact than a fan and generates less electromagnetic noise than a fan.

To increase the effectiveness of air-cooling, the device is structured so that airflow is directed along the drive train (the drive spool 42, motor 79, clutch 80, gearbox 81 and brake 82). Specifically, the ribs 102, 103 and 104 serve as guides for airflow around the drive train. The ribs are narrowly spaced from the drive train to generate higher air velocity and hence greater convective cooling. The path of airflow along the drive train of the devices shown in the Figures is represented by arrows 141. Generally, air flows between the drive train and the ribs, but air does flow both over and under the gearbox, clutch and motor. In addition, the ribs form compartments in the device that allow air to flow over or under all of the heat-producing or heat-sensitive internal components of the device, such as the processor, power controller, and other components.

Additional cooling is provided by mounting a metal foil on the inside surface of the anterior cover plate (any number of metals can be used, such as copper, steel and others). The metal foil extends from the channel beam to the superior end of the device and across the lateral width of the device. The metal foil absorbs heat produced by the motor and distributes the heat over a broad area, thereby increasing heat dissipation. (The metal foil also reflects infrared radiation back into the device to prevent the outside of the device from overheating the patient.) Furthermore, a layer of insulation is added between the anterior cover plate and the metal foil in the region of the brake and motor. The insulation reduces the rate of heat transfer to the anterior cover plate, and hence the patient. In addition, the motor, brake, electronics and other heat-producing components of the device are separated from the metal sheet and the outer surfaces of the device by an air-filled space. The space prevents direct heat conduction and further reduces the rate of heat transfer to the outer surfaces of the device and to the patient.

Additional cooling is provided by heat sinks 142 disposed on the motor, ribs and other components of the system. The heat sinks increase the surface area of these components, thereby allowing more heat to dissipate into the surrounding air flow. In addition, the motor, brake, gearbox and clutch are physically thermally connected. The physical thermal connections serve as additional heat sinks for these heat-producing devices. Additional heat sinks are provided in the form of braces 143 provided on the central rib 102. The braces both hold the motor controller 84 and provide a physical thermal connection between the motor controller and the central rib. The central rib thereby acts as a heat sink for the motor controller. Other connections throughout the device provide for additional heat sinks to further increase the ability to remove excess heat.

Temperature is measured with a temperature sensor, such as a thermometer or thermistor, mounted on the inside of the anterior cover plate (and near to the patient during use). The temperature sensor thereby monitors temperature in a location slightly warmer than the surface directly contacting the patient, meaning that potential patient overheating is detected early. (The body temperature of the patient may also be measured and tracked by the system with a separate sensor.) As described in reference to FIG. 7, if the temperature exceeds a pre-set temperature, then the processor is programmed to control the device to cool the device or patient or to prompt the user to take steps to cool the device or patient.

The device housing is made from a material having a low thermal conductivity, thereby reducing the chances that the patient overheats and also reducing the effect of leaving the device near a heat source or out in the Sun. In addition, other heat dissipation mechanisms may be added to the device to further cool the device during operation, such as radiators, thermoelectric cooling devices or spray/drip devices. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. An electro-mechanical chest compression device comprising:

a housing wherein the housing comprises an anterior cover plate, a superior cover plate attached to the anterior cover plate and an inferior cover plate attached to the anterior cover plate;

a metal foil mounted to the inside surface of the anterior cover plate;

a motor disposed in the housing;

a drive spool rotatably attached to the motor, wherein the motor is capable of rotating the drive spool;

a belt attached to the drive spool, said belt capable of extending at least partially around the chest of a patient, wherein rotation of the drive spool tightens the belt to compress the chest of the patient; and a means for circulating air, said means disposed in the housing, said means operable to increase the amount of airflow within the housing, wherein the means for circulating air is chosen from the group consisting of a blower and a fan.

2. The device off claim 1 further comprising a layer of insulation disposed between the anterior cover plate and the metal foil.

3. The device of claim 1 further comprising a layer of insulation disposed on the inside surface of the anterior cover plate.

4. An electro-mechanical chest compression device comprising:

a housing;

a motor disposed in the housing;

a rib disposed within the housing and oriented parallel to the motor, said rib being disposed to create a narrow space between the motor and the rib, the rib divides the device into at least two compartments, wherein the rib is attached to a component of the device such that the rib serves as a thermal barrier between compartments;

a drive spool rotatably attached to the motor, wherein the motor is capable of rotating the drive spool;

a belt attached to the drive spool, said belt capable of extending at least partially around the chest of a patient, wherein rotation of the drive spool tightens the belt to compress the chest of the patient; and a means for circulating air, said means disposed in the housing, said means operable to increase the amount of airflow within the housing, wherein the means for circulating air is chosen from the group consisting of a blower and a fan.

5. The device of claim 4 wherein the rib is further attached to the housing such that the rib prevents liquid from passing between compartments.

* * * * *